US009185956B2

(12) United States Patent
Batres et al.

(10) Patent No.: US 9,185,956 B2
(45) Date of Patent: Nov. 17, 2015

(54) HAIR CARRIER CLUTCH BAG

(75) Inventors: Deborah Ann Batres, Chatsworth, CA (US); Amalia Jean Moscoso, New York, NY (US)

(73) Assignee: Made3, LLC, New York, NY (US)

( * ) Notice: Subject to any disclaimer, the term of this patent is extended or adjusted under 35 U.S.C. 154(b) by 772 days.

(21) Appl. No.: 13/111,719

(22) Filed: May 19, 2011

(65) Prior Publication Data

US 2011/0284397 A1 Nov. 24, 2011

Related U.S. Application Data

(60) Provisional application No. 61/347,101, filed on May 21, 2010.

(51) Int. Cl.

| | |
|---|---|
| ***A45C 11/24*** | (2006.01) |
| ***A45C 15/00*** | (2006.01) |
| ***A45C 7/00*** | (2006.01) |
| ***A45C 11/26*** | (2006.01) |
| ***A45D 44/00*** | (2006.01) |

(52) U.S. Cl.

CPC ..... *A45C 11/24* (2013.01); *A45C 7/0095* (2013.01); *A45C 11/26* (2013.01); *A45C 15/00* (2013.01); *A45D 44/005* (2013.01)

(58) Field of Classification Search

CPC ..... A45C 11/24; A45C 7/0095; A45C 11/26; A45C 15/00; A45D 44/005

USPC ..... 206/8, 6.1, 489, 495

See application file for complete search history.

(56) References Cited

U.S. PATENT DOCUMENTS

| | | | | | |
|---|---|---|---|---|---|
| 485,509 | A | * | 11/1892 | Speed | 206/287 |
| 940,285 | A | | 11/1909 | Scruggs | |
| 1,085,950 | A | * | 2/1914 | Steinthal | 190/16 |
| 1,089,519 | A | | 3/1914 | Wordingham | |
| 1,557,989 | A | | 10/1925 | Dombrowsky | |

(Continued)

FOREIGN PATENT DOCUMENTS

WO 2012158299 A1 11/2012

OTHER PUBLICATIONS

Information Disclosure Statement (IDS) Letter Regarding Common Patent Application(s), dated Apr. 30, 2013.

(Continued)

*Primary Examiner* — Tri Mai

(74) *Attorney, Agent, or Firm* — Tillman Wright, PLLC; James D. Wright; David R. Higgins

(57) ABSTRACT

A hair carrier clutch bag for storing and transporting hair products such as wigs or hair extensions comprising an elongated body having a top, a bottom, a first side, a second side, an inner surface and an outer surface wherein the elongated body includes a plurality of fold sections and a top overlap section. At least one clip for securing a hair product coupled to the inner surface of the elongated body and offset from the top of the elongated body. A protective cover for covering the hair product including at least one cover sheet having a top, a bottom, a first side, a second side, an inner surface, and an outer surface wherein the first side of the cover sheet is coupled to the second side of the elongated body. The cover sheet is foldable about the joint formed between the cover sheet and the body. The body of the hair carrier clutch bag can be folded upon itself such that the folded body resembles a woman's clutch bag.

21 Claims, 5 Drawing Sheets

(56) References Cited

U.S. PATENT DOCUMENTS

| | | | | | |
|---|---|---|---|---|---|
| 1,579,023 | A | * | 3/1926 | Myers | 223/91 |
| 1,589,155 | A | | 6/1926 | Harris | |
| 1,610,107 | A | * | 12/1926 | Gaetano | 206/287 |
| 1,671,725 | A | | 5/1928 | Jones | |
| 1,679,101 | A | * | 7/1928 | Sternthal | 206/553 |
| 1,801,751 | A | | 4/1931 | Mills | |
| 2,408,344 | A | | 9/1946 | Scurrah | |
| 2,511,304 | A | | 6/1950 | Swanson | |
| 2,889,092 | A | | 6/1959 | Gibron | |
| 2,974,780 | A | * | 3/1961 | O'Donovan | 206/278 |
| 3,029,852 | A | * | 4/1962 | Wallace | 383/2 |
| 3,301,295 | A | * | 1/1967 | Fitch | 190/100 |
| 4,258,493 | A | * | 3/1981 | Kettlestrings et al. | 40/600 |
| 4,287,986 | A | | 9/1981 | Beck | |
| 4,297,986 | A | * | 11/1981 | Lehrer | 126/522 |
| 4,583,562 | A | * | 4/1986 | Stewart | 132/212 |
| D313,524 | S | * | 1/1991 | Barnes | D6/553 |
| 5,361,948 | A | | 11/1994 | Batts | |
| 5,363,953 | A | * | 11/1994 | Carter | 206/6.1 |
| D364,188 | S | | 11/1995 | Wolff | |
| 5,503,476 | A | * | 4/1996 | Hamdan | 383/9 |
| 5,509,588 | A | * | 4/1996 | Kimball | 223/98 |
| 5,595,331 | A | * | 1/1997 | Leistner | 223/91 |
| 5,664,591 | A | | 9/1997 | Potut | |
| 5,779,033 | A | * | 7/1998 | Roegner | 206/6.1 |
| 5,890,587 | A | * | 4/1999 | Roegner | 206/6.1 |
| D412,343 | S | | 7/1999 | Offenhauer | |
| 6,023,819 | A | | 2/2000 | Wong et al. | |
| 6,095,213 | A | | 8/2000 | Roegner | |
| D467,616 | S | | 12/2002 | Holland | |
| 6,578,706 | B2 | * | 6/2003 | Thompson | 206/214 |
| 6,612,000 | B2 | | 9/2003 | Housley | |
| 6,883,769 | B2 | * | 4/2005 | Shamoon | 248/447 |
| D514,435 | S | | 2/2006 | Bhavnani | |
| D566,536 | S | | 4/2008 | Wolff et al. | |
| D583,417 | S | | 12/2008 | Maier-Hunke | |
| D590,993 | S | | 4/2009 | Hsu | |
| 7,537,142 | B2 | | 5/2009 | Yau et al. | |
| 7,815,080 | B2 | * | 10/2010 | Zuckerman | 223/96 |
| D637,480 | S | | 5/2011 | Chen et al. | |
| D684,316 | S | | 6/2013 | Batres et al. | |
| D684,317 | S | | 6/2013 | Batres et al. | |
| 2004/0055616 | A1 | | 3/2004 | Twomey | |
| 2007/0131239 | A1 | | 6/2007 | Harrison et al. | |
| 2008/0257766 | A1 | | 10/2008 | Kamada | |
| 2012/0024727 | A1 | * | 2/2012 | Dragan | 206/286 |
| 2013/0206628 | A1 | | 8/2013 | Batres et al. | |

OTHER PUBLICATIONS

YouTube "Foxylocksextension storage case competition!!" uploaded Apr. 6, 2010.
www.sallybeauty.com/hair-extension-case/SBS-387866,default,pd.htm.
http://foxylocksextensions.com/category_141Storage-Cases.htm.
http://dennipep.com/au/skin1/images/categories/hairdress-header.jpg.
http://www.afrocare.com/cart.php?target=product&product_id3366&substring=.
http://jodienas.blogspot.com, Jan. 31, 2010.
YouTube "FoxyLocksExtensions Storage Case Competition—Hair Extension Roll" uploaded Apr. 15, 2010.
www.crafster.org/forum/index.php?topic=3390528.0, Feb. 26, 2010.
www.hairroinchichboutique.com.
"International Search Report" and "Written Opinion of the International Search Authority" (United States) in Batres, Deborah, International Patent Application Serial No. PCT/US2012/034082, dated Jul. 3, 2012, 11 pages.
Information Disclosure Statement (IDS) Letter Regarding Common Patent Application(s), dated Jun. 29, 2015.

* cited by examiner

HAIR CARRIER CLUTCH BAG

CROSS-REFERENCE TO RELATED APPLICATIONS

This application claims the benefit of U.S. Provisional Patent Application No. 61/347,101 filed May 21, 2010 and entitled "Carrying Case for Hair Extensions," the entire disclosure of which is incorporated herein by reference to the extent permitted by law.

BACKGROUND OF THE INVENTION

The market and use for hair enhancement products is continually growing. The use of hair extensions, wigs, and falls made of human and synthetic hair are all increasing in frequency and amount. A variety of people are buying and utilizing various hair systems on the market today. One particular niche is the use of hair extensions to supplement a user's natural hair, often to create the appearance of longer and fuller hair. Further, hair extensions of varying colors can be used to create highlights or depth of color on demand. Thus, a user may have a somewhat conservative hair style for their work and use a set of hair extensions to create long flowing hair styles for weekends or more formal social engagements. Further, the use of wigs has become more common for a variety of uses. Many cancer patients use wigs after losing their hair through either radiation or chemotherapy treatment or both. Many users are turning to wigs to quickly change their hairstyle. A person with multiple wigs may have multiple colors, styles, and lengths that can be selected any given time and used at will to provide a desired appearance for that particular day.

With the increased popularity of hair extensions, wigs, falls and their more widespread use, many users are looking for a way to conveniently store their hair products. Further, users are continually looking for a good way to travel with their hair products wherein the hair does not get damaged. In addition, many of the users of these products are fashion conscious and would desire a fashionable apparatus for storing and travelling with their hair products.

There are a couple attempts to provide the users of these hair products an approach for storing, carrying, and transporting the hair products. One existing attempt is essentially a soft bag of fabric that surrounds the entire length of hair extensions. The hair extension is tied up at the top of the bag and ties along the length bring in the excess fabric to narrow the profile. Another attempt is a "hair dress" that wraps around the hair extensions to look like a woman's dress. Further, another hair carrier holds extensions in a horizontal position and the hair is merely placed in a pocket like enclosure wherein the hair bunches up and can damage itself when the pocket is moved or shifts positions.

All of the existing attempts to meet the needs of consumers of hair extension carriers fail to securely hold the hair product in the carrier and fail to protect the hair product from damage from its own weight or from an outside force. Further, none of the existing offerings are configured to carry products other than hair extensions.

Thus, there is a need in the art for a hair carrier apparatus to store hair products including extensions, wigs, and falls. There is a further need to provide a component storage system that can carry the hair products compactly for travel. There is a further need in the art for a hair storage and travel carrier that is fashionable and has the appearance of a clutch purse currently carried by women as a fashion accessory.

BRIEF SUMMARY OF THE INVENTION

The hair carrier clutch bag of the present invention is directed toward a travel and storage apparatus to be used for storing and transporting hair products such as wigs, hair extensions or falls. The hair carrier clutch bag of the present invention includes an elongated body, at least one hair securing clip, a protective cover sheet, and a closure. An embodiment of the present hair carrier clutch bag may also include a second protective cover sheet or enclosure panel, an internal storage pocket, and/or a hanger slot that allows the unfolded clutch bag to be hung by a conventional clothes hanger in a closet, on a hook, towel rack, door knob, and so forth.

The hair products are secured within the present hair carrier clutch bag using one or more clips coupled to an inner surface of the body of the hair carrier. The hair carrier clutch bag of the present invention includes a protective cover sheet that is positioned over the hair product and the inner surface of the body thereby sandwiching the hair product between the protective cover sheet and the body. An embodiment of the hair carrier of the present invention may also include a protective enclosure panel that is located opposite the protective cover sheet, but folds over to overlap a portion of the protective cover sheet. The protective enclosure panel may be removably coupled to the protective cover sheet at the overlap.

An embodiment of the elongated body of the hair carrier of the present invention includes multiple fold sections and a top overlap section wherein the elongated body may be sequentially folded by folding fold sections onto adjacent fold sections and then folding the top overlap section to rest on the outer surface of an applicable fold section. The overlap section may be removably coupled to the applicable fold section with a closure mechanism. The folded body of the hair carrier clutch bag of the present invention is configured to resemble a woman's clutch-type bag as known in the art.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 1:
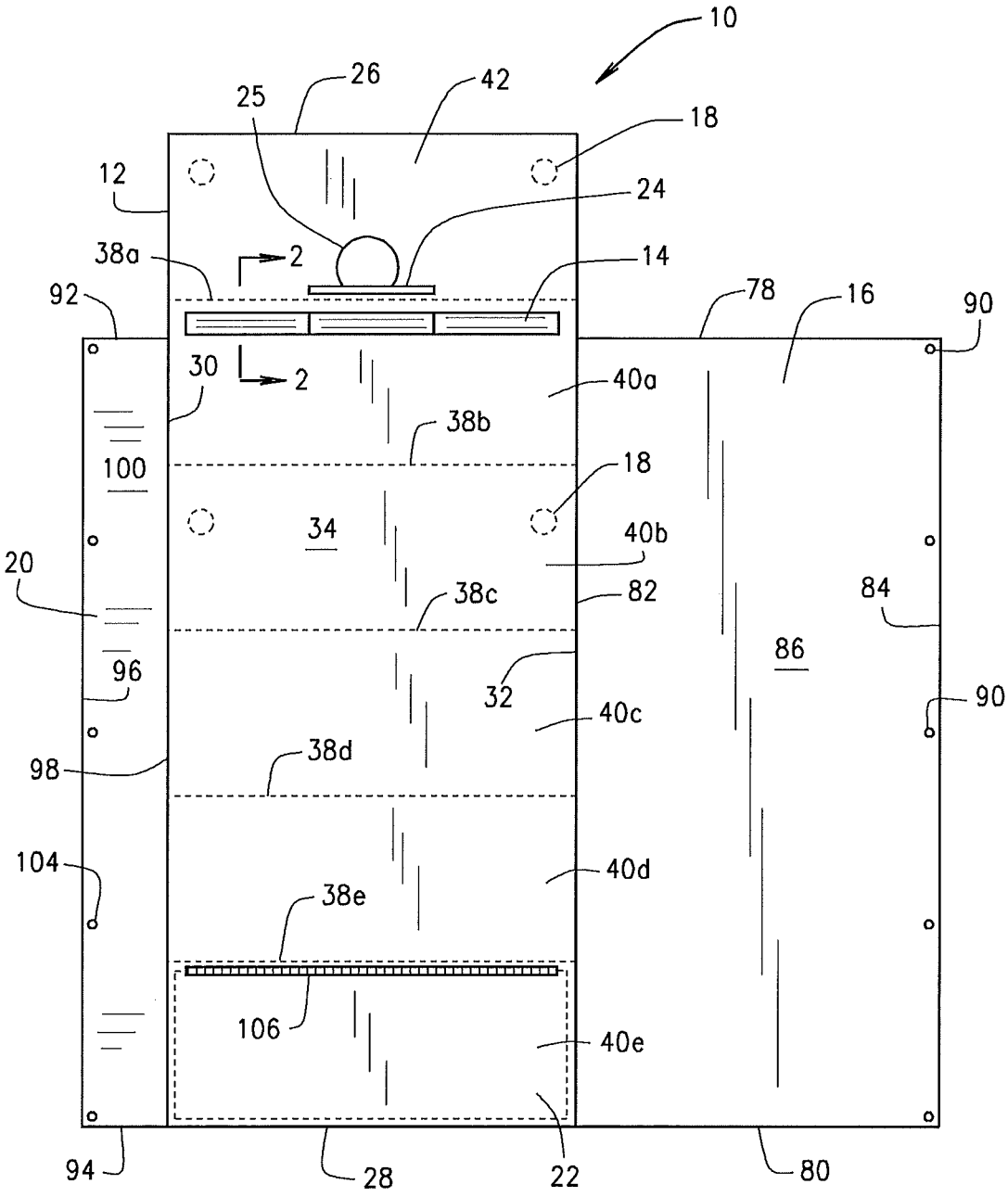
FIG. 1 is a top view of one embodiment of a hair carrier clutch bag constructed in accordance with the teachings of the present invention showing the present hair carrier bag in its fully open position.

FIG. 1 illustrates an embodiment of a hair carrier clutch bag 10 of the present invention. As seen in FIG. 1, hair carrier clutch bag 10 includes an elongated body 12, at least one hair securing clip 14, a protective cover sheet 16 and a closure 18. An embodiment of hair carrier clutch bag 10 may also include a second protective cover sheet or enclosure panel 20, an internal pocket 22, and/or a hanger slot 24.

Figure 2:
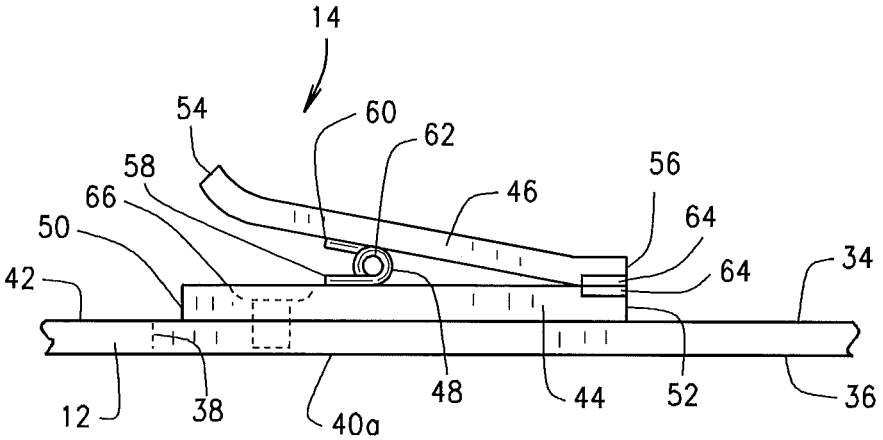
FIG. 2 is a fragmentary cross-sectional view of a clip of the hair carrier clutch bag of FIG. 1 taken generally along line 2-2 of FIG. 1 in the direction of the arrows.
Figure 5:
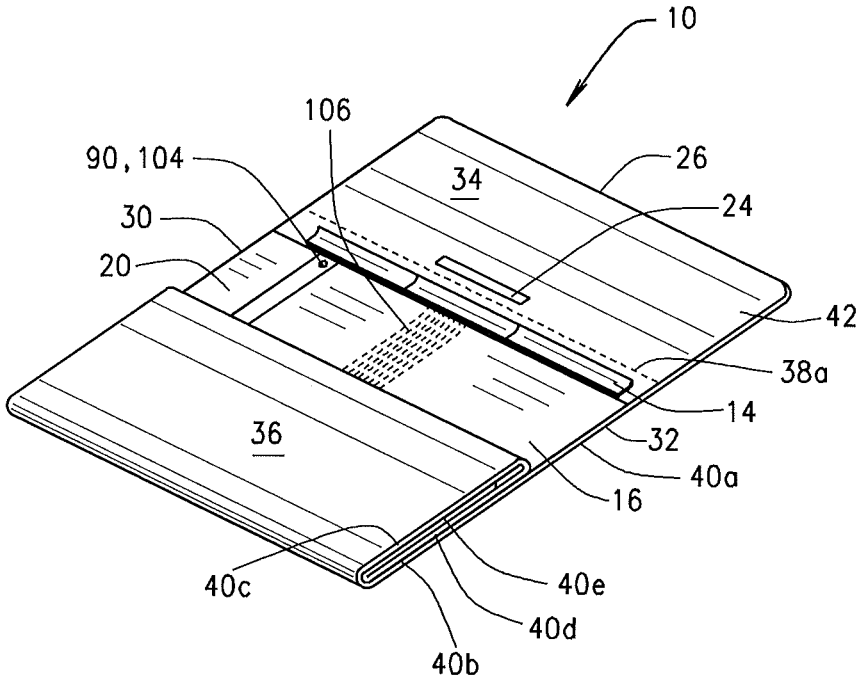
FIG. 5 is a perspective view of the hair carrier clutch bag of FIG. 1 showing the length of the present hair carrier clutch bag partially folded.
Figure 6:
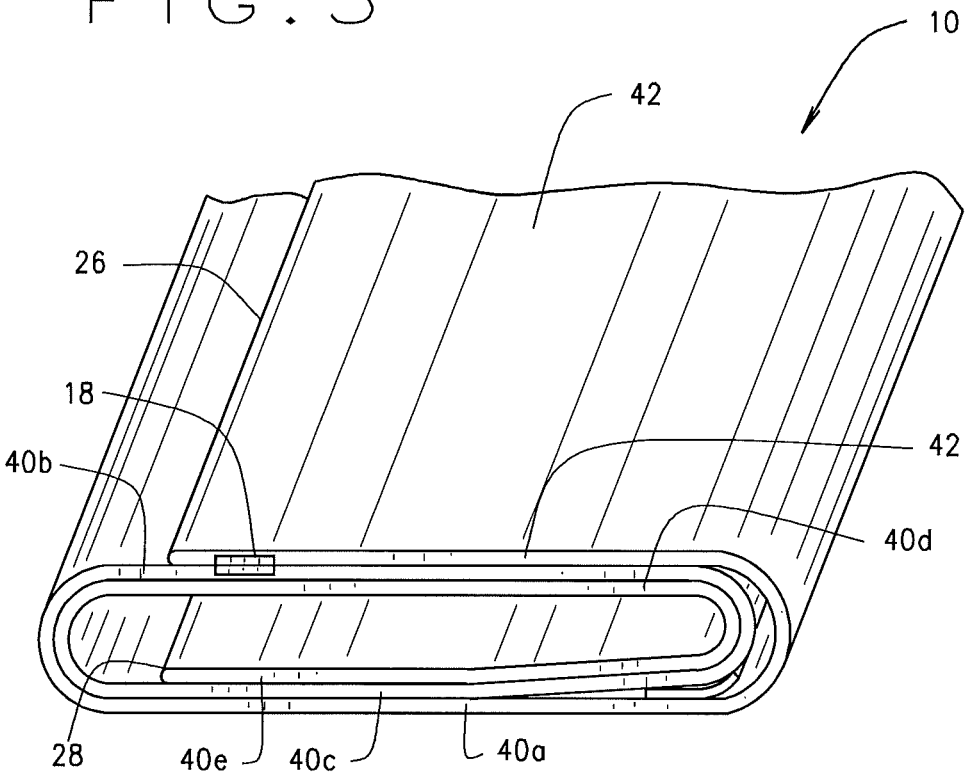
FIG. 6 is a partial perspective view of the hair carrier clutch bag of FIG. 1 showing the length of the present hair carrier bag in its fully folded position.
Figure 7:
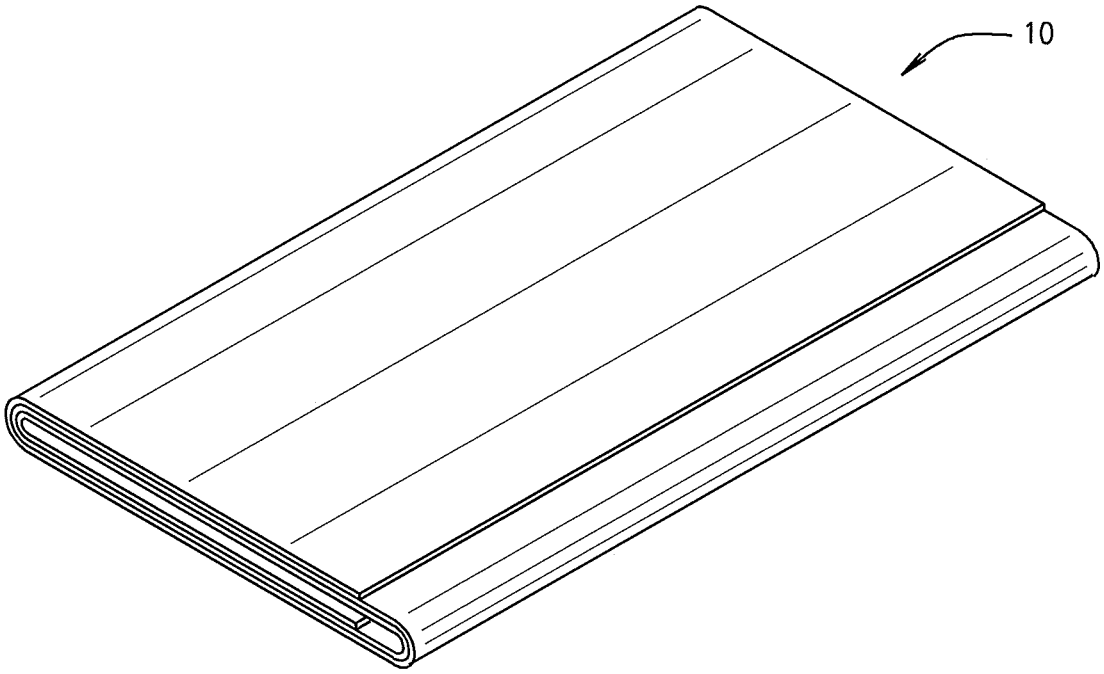
FIG. 7 is a perspective view of the hair carrier clutch bag of FIG. 1 in its fully folded position resembling a clutch bag.

Elongated body 12 includes a top 26, a bottom 28, a first side 30, a second side 32, an inner surface 34, and an outer surface 36 (FIGS. 2 and 5). A length of body 12 is the distance between top 26 and bottom 28 and a width of body 12 is the distance between first side 30 and second side 32. Elongated body 12 may further include one or more longitudinal stitches or creases 38 orientated substantially parallel to top 26 and bottom 28 spanning substantially the width of body 12 and disposed along a length of body 12. The longitudinal stitches or creases may be equally spaced along the length thereby dividing body 12 into a plurality of fold sections 40. Further, the stitches or creases may also define a top overlap section 42 of body 12 proximate top 26. The embodiment of the hair carrier of the present invention shown in FIG. 1 includes five (5) fold sections 40*a*, 40*b*, 40*c*, 40*d*, and 40*e* and top overlap section 42 and five stitches/creases 38*a*, 38*b*, 38*c*, 38*d*, and 38*e*. As shown in FIG. 1, the fold sections 40 may be substantially equally sized. Alternatively, the length of fold sections 40*a-e* may slightly increase from bottom 28 to top 26 (i.e. fold section 40*d* may be slightly longer than fold section 40*e*, fold section 40*c* may be slightly longer than fold section 40*d*, etc.) to facilitate folding of the hair carrier. Body 12 may be sequentially folded by folding fold section 40*e* onto fold section 40*d*, folding folded sections 40*e* and 40*d* onto fold section 40 *c*, folding folded sections 40*e*, 40*d* and 40*c* onto fold section 40*b*, folding folded sections 40*e*, 40*d*, 40*c*, and 40*b* onto fold section 40*a*, and then folding top overlap section 42 to rest on outer surface 36 of fold section 40*b* as best illustrated in FIG. 6. The folded body 12 resembles a woman's clutch-type bag as known in the art when completely folded.

The length of body 12 corresponds to the length of the hair extension or wig. The more common lengths of hair extensions range from about ten inches (10") to about twenty inches (20"). However, wigs or hair extensions may be any length known in the art. One embodiment of hair carrier 10 may include a body length ranging from about twelve inches (12") to about forty inches (40"). Another embodiment may include a body length ranging from about twenty-four inches (24") to thirty-six inches (36"). Another embodiment may include a length of about thirty-three inches (33"). The width of body 12 is selected to provide the capacity to fit the hair products. Further, because an embodiment of hair carrier 10 is configured to resemble a standard woman's clutch bag, the width generally corresponds to widths of standard clutch bags as known in the art. One embodiment includes a width of body 12 ranging from about six inches (6") to about eighteen inches (18"). Another embodiment may include a width of body 12 ranging from about nine inches (9") to about fifteen inches (15"). Another embodiment may include a width of body 12 of about twelve inches (12"). It is recognized and anticipated that body 12 may be configured to accommodate any length and/or width.

Inner surface 34 of body 12 likewise forms the inner surface of fold sections 40*a-e* and is comprised of a material that will not damage the hair products when the body 12 is folded about itself as described above. Material used for the inner liner disposed on inner surface 34 may include, but shall not be limited to: silk, polyester, nylon, plastic, cotton fabric, vinyl, microfiber, canvas, fleece, wool, chamois, imitation chamois, woven fabric, suede, any other suitable material now known or hereafter developed, or any combination thereof. In one embodiment, inner surface 34 of top overlap section 42 is covered by the same material as fold sections 40*a-e*. However, inner surface 34 of top overlap section 42 may alternatively be of the material of outer surface 36 as described below.

Outer surface 36 of body 12 is covered in a finish material meant to be exposed to the elements, normal wear and tear, as well as to protect the interior contents of the hair carrier 10. In addition, the material of outer surface 36 may also be chosen for its color, finish, pattern, texture, or any other aesthetic reason. The material of outer surface may include, but is not limited to: silk, polyester, nylon, canvas, wool, vinyl, plastic, leather, animal skin, microfiber, other polymers, suede, or any other suitable material now known or hereafter developed, or any combination thereof. The material of outer surface 36 may be patterned and/or textured to resemble natural materials such as animal skin, leather, or other more exotic or expensive materials. The material of outer surface 36 may be any color within the visible spectrum. Hair carrier 10 may also include a decorative border (not shown) around its perimeter that covers the exposed edges of the fabric associated with the inner and outer surfaces.

Hair securing clip 14 may be any mechanism known or hereafter developed that can secure the hair product and keep the portion secured from being dislodged during transport. As shown in FIG. 2, one embodiment of the present invention utilizes a spring loaded clip 14 to secure the hair product. Securing clip 14 includes a fixed arm 44, a clamp arm 46, and a spring 48 disposed between fixed arm 44 and clamp arm 46. Fixed arm 44 includes a first end 50 and a second end 52. Clamp arm 46 includes a first end 54 and a second end 56. Spring 48 includes a fixed end 58, a loading end 60 and a spring coil 62 disposed therebetween. Loading end 60 engages clamping arm 46 and fixed end 58 engages fixed arm 44 and spring 48 is pre-loaded such that second end 56 of clamping arm 46 exerts a downward force upon second end 52 of fixed arm 44. Spring 48 is further configured such that when a user puts a downward force directly on first end 54 of clamping arm 46, the spring resists the movement. When the user applies a downward force on first end 54 of clamping arm 46 greater than the spring force, clamping arm pivots about spring 48 and second end 56 moves upward. When second end 56 disengages second end 52 of fixed arm 44, the hair product can be placed therebetween. When the user releases the downward force on first end 54 of clamping arm 46, the spring force brings second end 56 of the clamping arm back into proximate contact with second end 52 of fixed arm 44 thereby securing the hair product therebetween. One or both of second ends 52 and 56 may have a pad 64 to dampen the force applied to the hair products. Pad 64 may be rubber, felt, elastomeric, polymeric, or any other material now known or hereafter developed that performs the function in an equivalent manner.

FIG. 2 illustrates fixed arm 44 of clip 14 being coupled to body 12 by a fastener 66. Fastener 66 may be a rivet fastener, glue, hook and loop fastener, bolt, screw, threaded fastener, or other mechanical fastener known or hereafter developed. Alternatively, fixed arm 44 may be coupled to body 12 using any suitable means including sewn or stitched to body 12. FIGS. 1 and 2 illustrate hair securing clip 14 being coupled to inner surface 34 of body 12 on fold section 40*a* proximate stitch 38*a* between fold section 40*a* and top overlap section 42. In this regard, clip 14 is positioned and located a distance offset from the top 26 of body 12, this offset distance defining substantially the length of the top overlap section 42. FIG. 1 illustrates clip 14 being three individual clamp members as describe above. However, any number of clip members 14 may be utilized and the clip members may be of the same size or may be different sizes. For example, multiple clip members allow a user to secure multiple hair extensions individually, or allow a user to secure a portion of their hair extensions and then secure another portion or group of hair extensions without having to release the previously secured hair extensions that could dislodge or move. Alternatively, clip 14 may be one member that spans substantially the entire width of the body 12.

Hanger slot 24 is configured for the hooked portion of a clothes hanger or other similar device to pass through the slot wherein the length of the slot is such that the entire hanger does not pass through thereby allowing an unfolded hair carrier 10 to be hung in a closet or behind a door, on a hook, door knob, towel rack, or other hanging fixture when traveling or for storage. An optional fabric piece or loop 25 (FIG. 1) may also be provided adjacent hanger slot 24, or in place thereof, for likewise allowing the hair carrier 10 to be hung therefrom. In this regard, the fabric piece 25 can be attached to either the inner or outer surface 34 or 36 of body 12 and it can be fed or extended through the hanger slot 24 if slot 24 is incorporated into the carrier 10. The loop 25 can be hooked or hung from anywhere or anything to provide an additional hanging option.

Figure 3:
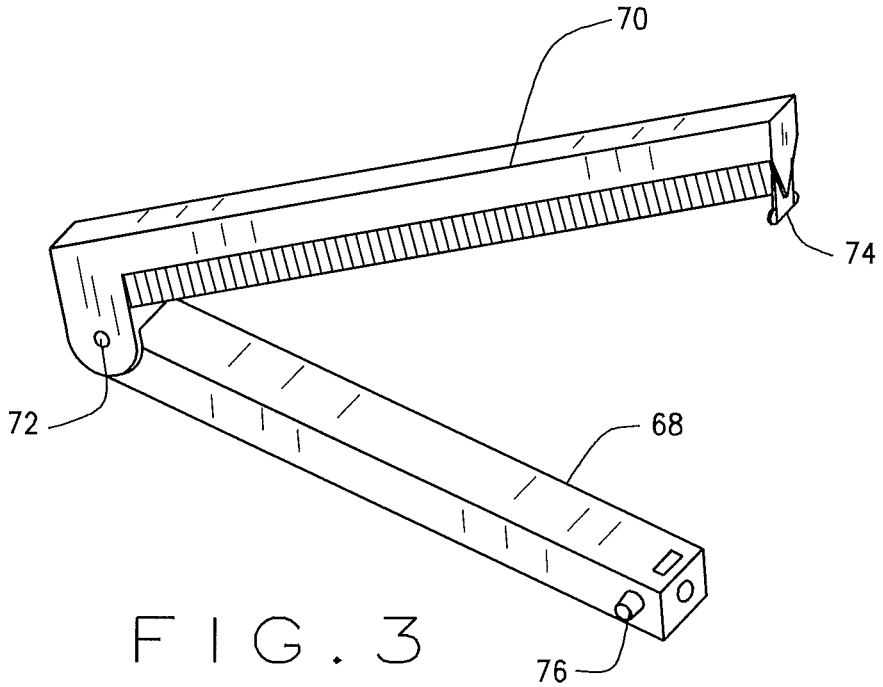
FIG. 3 is a perspective view of another embodiment of a clip for use with the present hair carrier clutch bag.

Clip 14 is not limited to the clamp embodiment shown and may be any mechanism known or hereafter developed in the art capable of securing hair products between two members. FIG. 3 illustrates another embodiment of clip 14 comprising a fixed arm 68, a clamp arm 70, a hinge 72, a clasp 74 and a release 76. The hair extensions can be laid over fixed arm 68 and clamp arm 70 may be pivotally moved into contact with the hair extensions and fixed arm 68. Clasp 74 engages a mechanism in fixed arm 68 to temporarily fix their relative position. The hair extensions can be removed for use by pressing release 76 and pivotally moving clamp arm 70 upward. Another embodiment includes using pre-tensioned elastic straps wherein each end of the strap is coupled to the inner surface 34 of body 12 and wherein the hair product is secured by stretching the elastic band, placing the hair product between the elastic band and body 12 and releasing the band to contact the body 12 thereby securing the hair product between the elastic band and the body 12. Any plurality of elastic bands can be coupled to the body 12 similar to clip 14. Yet another embodiment includes a series of sleeves or netting built into or coupled to inner surface 34 that are configured to receive the comb section of a standard hair extension in a downward orientation to replicate the way the hair extension is secured to a person's head thereby temporarily securing the hair extension to body 12. Still further, clip 14 may include a pair of bar magnet members wherein a bottom bar is coupled to the inner surface 34 of body 12 and a top bar is magnetically attachable to/removable from the bottom bar. The hair product can be placed on top of the bottom bar and sandwiched between the top and bottom bars when the top bar is coupled to the bottom bar. Still other clip mechanisms are envisioned and anticipated. Any mechanism for securing hair products within the carrier of the present invention in a substantially equivalent manner is envisioned and is within the scope of the present invention.

Alternatively, clip 14 as described above may be disposed parallel and proximate first side 30 or second side 32. This embodiment includes a clip configured to match the length of one or more fold sections 40 such that clip 14 does not impede the folding of the hair carrier clutch bag of the present invention. The hair products may be in a horizontal configuration in this embodiment, or they may be held in position along one side thereof.

FIG. 1 illustrates protective cover sheet 16 having a top 78, a bottom 80, a first side 82, a second side 84, an inner surface 86, an outer surface 88, and at least two fasteners 90. First side 82 is coupled to second side 32 of body 12 such that protective cover sheet 16 is configured to fold over and lie above inner surface 34 of body 12. Inner face 86 of protective cover sheet 16 faces inner surface 34 of body 12 when folded. Bottom 80 of protective cover sheet 16 is generally aligned with or configured to be slightly above bottom 28 of body 12 as shown. Cover sheet 16 also includes fasteners 90 that couple cover sheet 16 to body 12 or to protective enclosure panel 20 as described below.

Figure 4:
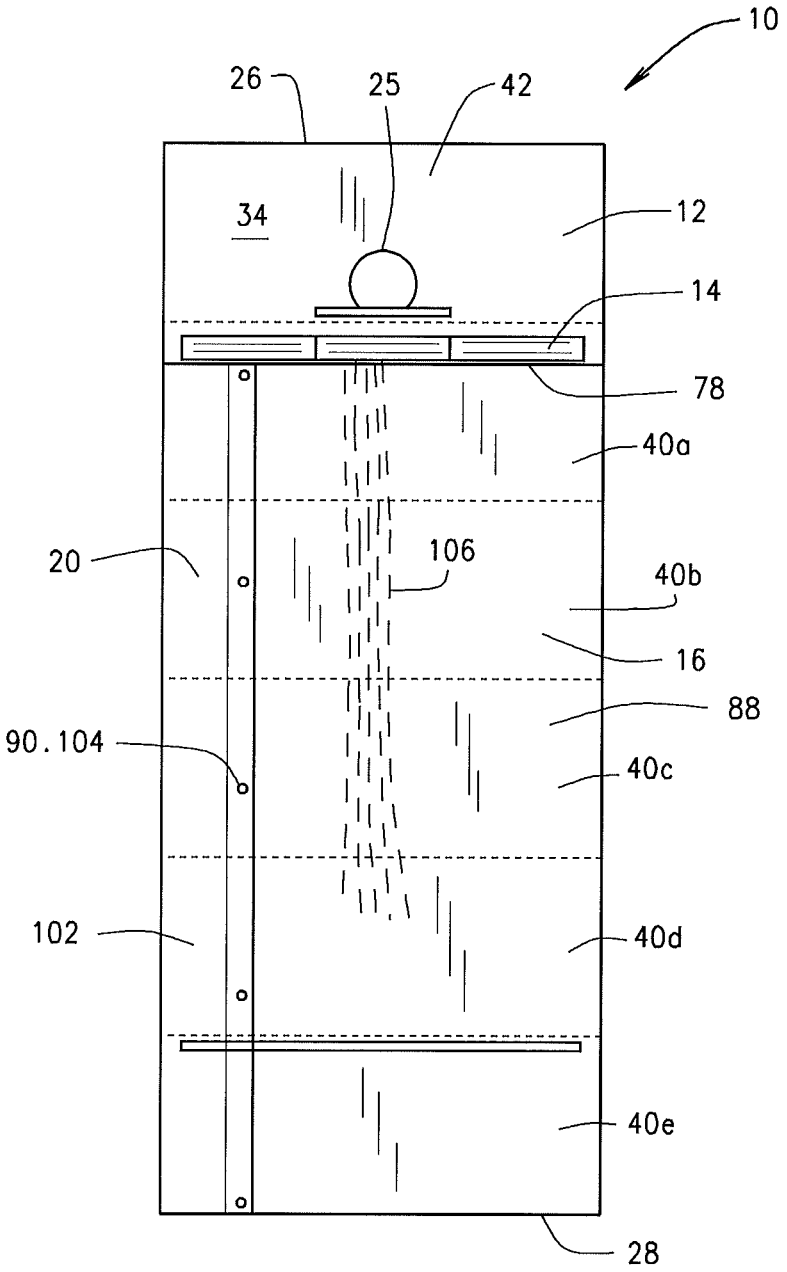
FIG. 4 is a top view of the hair carrier clutch bag of FIG. 1 showing the protective cover sheet and enclosure panel in their folded position.

As seen in FIG. 4, cover sheet 16 folds along the joint between second side 32 of body 12 and first side 82 of protective cover sheet 16 and is configured to cover or substantially cover inner surface 34 of body 12. Top 78 may be configured to lie below clip 14 as shown. Alternatively, top 78 of cover sheet 16 may cover clips 14 to protect the inner surface of body 12 when the hair carrier of the present invention is folded for storage or transport. Cover sheet 16 utilizes fasteners 90 to fix cover sheet 16 over the hair product in this overlapped position. Protective cover sheet 16 may be fastened directly to inner surface 34 of body 12 and can cover substantially all of the hair product located therebelow. Alternatively, cover sheet 16 may be configured such that its width is slightly less than the width of body 12 and protective enclosure panel 20 may be folded over to overlap protective cover sheet 16 as shown in FIG. 4. Protective cover sheet 16 may be removably coupled to protective enclosure panel 20 using fasteners 90 and fasteners 104 as described below. Alternatively, bottom 80 of protective cover sheet 16 may be coupled to bottom 28 of body 12 and foldable over inner surface 34 from the bottom 28 of body 12. One embodiment includes fasteners 90 disposed along the top 78 and/or the sides 82, 84 of cover sheet 16 and mateable with complimentary fasteners disposed on inner surface 34 of body 12. It is also recognized that cover sheet 16 could be coupled or attached to the first side 30 of body 12 and folded along the joint between the first side 30 of body 12 and the second side 84 of the protective cover sheet 16.

As seen in FIG. 1, a second protective cover sheet or enclosure panel 20 includes a top 92, a bottom 94, a first side 96, a second side 98, an inner surface 100, an outer surface 102, and fasteners 104. Second side 98 of protective enclosure panel 20 is coupled to first side 30 of body 12 such that protective enclosure panel may fold and overlap inner surface 34 of body 12 as shown in FIG. 1. Top 92 may be configured to end just below clips 14, or alternatively may cover clips 14 to provide abrasion protection between the inner surface of top overlap section 42 and the clips 14. Fasteners 90 and 104 may be any mateable, removable fastener now known or hereafter developed including, but not limited to, snap closures, magnets, buttons, hook and loop fasteners, or other equivalent fastener. Fasteners 90 and 104 preferably have a flat profile as the fold sections 40*a-e* fold over each other and a flat profile will provide a better overall appearance. In this regard, the fasteners 90 and 104 are positioned and located respectively on sheet 16 and panel 20 so as to cooperatively engage each other when folded into their overlapping positions. It is also recognized that panel 20 could be coupled or attached to the second side 32 of body 12 if cover sheet 16 is coupled to the first side 30 of body 12. Still further, any amount of overlap between cover sheet 16 and enclosure panel 20 is possible. Also, cover sheet 16 and panel 20 can be configured to mate with each other at the center or middle portion of inner surface 34 with substantially little or no overlap. Any combination of cover sheet 16 and enclosure panel 20 is envisioned and anticipated.

Protective cover sheet 16 and protective enclosure panel 20 may be comprised of a material that will not damage the hair products when the body 12 is folded about itself as described above. Material used for protective cover sheet 16 and protective enclosure panel 20 may include, but shall not be limited to: silk, polyester, nylon, plastic, cotton fabric, vinyl, microfiber, fleece, chamois, imitation chamois, woven fabric, suede, any other suitable material now known or hereafter developed, or any combination thereof. In one embodiment, protective cover sheet 16 and protective enclosure panel 20 are clear plastic or vinyl. Protective cover sheet 16 and protective enclosure panel 20 may be the same material or may each be a different material.

An embodiment of the present invention may include an internal pocket 22 disposed in any fold panel 40*a*-40*e*. In the embodiment of FIG. 1, internal pocket 22 is located within fold panel 40*e*. Internal pocket 22 may be any configuration known in the art and may be closeable with zipper 106 or any other known closure mechanism. Internal pocket 22 may be sewn into the liner comprising inner surface 34 or may just be a pocket formed between stitch/crease 38*e* and bottom 28. Internal pocket 22 may include substantially the entire area of fold panel 40*e* as shown, or may be any size within the area of fold panel 40*e*. Internal pocket 22 may be used to store and carry hair styling products, pins, barrettes, hair bands, any other hair care related items of the user, other personal items of the user carried during travel including toiletries, or any other products desired by the user.

Further, as shown in FIG. 1, closure 18 is a pair of magnets between the outer surface 36 and the inner surface 34 in both top overlap section 42 and fold section 40*b*. The magnets are configured such that when the hair carrier 10 is folded upon itself as described below, the magnet in fold section 40*b* is proximate the magnet in overlap section 42 wherein the portions of the magnet facing each other in the folded position have opposite polarity. As such, the magnets are attracted to each other and thereby temporarily couple top overlap portion 42 to fold section 40*b*. Alternatively, closure 18 may be any fastener now known or hereafter developed in the art including snaps, zippers, buttons, grommets, clips, buckles, straps, studs, hook and loop fasteners, clasps, or any other coupling mechanism.

In use, hair carrier 10 of the present invention is used to store and transport hair products such as wigs, hair extensions, falls, and other real or imitation hair strands. Hair carrier 10 of the present invention is positioned in an unfolded and open orientation as shown in FIG. 1. This unfolded and open orientation includes both protective cover sheet 16 and protective enclosure panel 20 extending outwardly from body 12. At this time, the hair product, such as hair extensions 106 may be secured within clip 14 (see FIGS. 4 and 5). For example, one end of a hair extension may be secured in clip 14 and the second end may extend longitudinally substantially parallel to first and second sides 30 and 32 toward second end 28.

Next, the first protective cover sheet 16 is folded over onto body 12 such that inner surface 86 of protective cover sheet 16 faces inner surface 34 of body 12. This traps the hair product between the inner surface 34 of body 12 and the first protective cover sheet 16. Next, if the second protective cover sheet or enclosure panel 20 is present, it is folded over second end 84 of protective cover sheet 16. At this time, protective cover sheet 16 and protective enclosure panel 20 are coupled together using mating fasteners 90 and 104. FIG. 4 illustrates hair carrier 10 at this stage of use. Alternatively, if no protective enclosure panel 20 is provided, protective cover sheet 16 could be coupled to inner surface 34 of body 12 proximate first side 30 in a similar manner.

As shown in FIG. 5, body 12 is next folded upon itself starting at bottom end 28. Fold section 40*e* is folded over upon fold section 40*d* such that inner surface 34 of fold section 40*e* faces inner surface 34 of fold section 40*d*. Folded sections 40*e* and 40*d* are then folded over upon section 40*c* such that outer surface 36 of fold section 40*e* faces inner surface 34 of fold section 40*c*. The folded sections 40*e*, 40*d*, and 40*c* are next folded over onto fold section 40*b* wherein outer surface of fold section 40*d* faces inner surface 34 of fold section 40*b*.

The folded sections 40*e*, 40*d*, 40*c*, and 40*b* are then folded over onto fold section 40*a* wherein the outer surface of fold section 40*c* faces inner surface 34 of fold section 40*a*. At this point, body 12 has been folded until all the fold sections 40*a-e* are folded upon the other and only top overlap section 42 remains unfolded. Top overlap section 42 is now folded onto fold section 40*b* such that it overlaps fold section 40*b*. As shown in FIG. 6, top overlap section 42 is temporarily and removably coupled to the outer surface 36 of fold section 40*b* by means of closure 18.

The completely folded hair carrier 10 of the present invention is configured to resemble a woman's clutch bag to provide users a convenient, stylish, effective, safe and stylish apparatus in which to store and transport their hair products, including wigs, hair extensions and falls. The folded hair carrier 10 of the present invention may be placed in checked or carryon luggage or may even be carried as a purse by the user during travel. Folded hair carrier 10 may also be used to store hair products in a drawer or closet while protecting the hair product and taking up minimal storage space.

From the foregoing, it may be seen that the hair carrier clutch bag of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense.

Thus, there has been shown and described several embodiments of a hair carrier clutch bag, which embodiments fulfill all the objects and advantages sought therefor. Many changes, modifications, variations and other uses and applications of the present invention will, however, become apparent to those skilled in the art after considering this specification and the accompanying drawings. All such drawings, modifications, variations and other uses and applications which do not depart from the spirit and scope of the present invention are deemed to be covered by the present invention which is limited by the claims which follow.

We claim:

1. A hair carrier clutch bag comprising:

(a) an elongated body having a top, a bottom, a first side, a second side, an inner surface and an outer surface, said elongated body including at least an upper fold section, a middle fold section, a lower fold section, and a top overlap section;

(b) a hair product comprising a plurality of strands of material arranged to resemble a quantity of human hair, the hair product lying lengthwise along the elongated body such that a respective portion of the hair product lies along each of the upper fold section and the middle fold section;

(c) a clip coupled to the inner surface of said elongated body, the clip securing the hair product in place along the elongated body;

(d) a protective cover that covers said hair product such that the hair product lies between the elongated body and the protective cover, the protective cover including a first cover sheet having a top, a bottom, a first side, a second side, an inner surface, and an outer surface wherein one side of said first cover sheet is coupled to one side of said body and said first cover sheet is foldable about the joint formed between said one side of said first cover sheet and said one side of said body, a top edge of said first cover sheet being positioned below said clip; and (e) a closure;

(f) wherein, in a first state, the elongated body is opened flat; and (g) wherein, in a second state, the elongated body is rolled into a closed state, in which it resembles a clutch bag, such that:

(i) the inner surface of the lower fold section is folded against the inner surface of the middle fold section, (ii) the lower and middle fold sections are folded against the top fold section such that the outer surface of the lower fold section is disposed against the inner surface of the upper fold section, (iii) the top overlap section is folded over the upper, middle and lower fold sections such that the top overlap section is disposed against the outer surface of the middle fold section, and (iv) the closure temporarily couples said top overlap section to the outer surface of one of said fold sections, and (v) the hair product is folded within the elongated body.

2. The hair carrier clutch bag of claim 1 wherein said clip is positioned and located a distance offset from the top of said elongated body, said offset distance corresponding to the vertical dimension of said top overlap section.

3. The hair carrier clutch bag of claim 1 wherein said protective cover further includes an enclosure panel having a top, a bottom, a first side, a second side, an inner surface, and an outer surface wherein said one side of said enclosure panel is coupled to the opposite side of said body and said enclosure panel is foldable about the joint formed between said one side of said enclosure panel and said opposite side of said body, said first cover sheet and said enclosure panel being removably coupled to each other when folded about their respective joints formed with said body.

4. The hair carrier clutch bag of claim 3 wherein said enclosure panel is configured to overlap a portion of said first cover sheet.

5. The hair carrier clutch bag of claim 1 further comprising a storage pocket associated with the inner surface of said elongated body.

6. The hair carrier clutch bag of claim 5 wherein the storage pocket is built into the inner surface of said body.

7. The hair carrier clutch bag of claim 6 wherein said storage pocket includes a zipper.

8. The hair carrier clutch bag of claim 1 wherein said top overlap section includes a hanger slot configured to receive the hook portion of a clothes hanger wherein said hair carrier clutch bag may be hung from a hanging fixture.

9. The hair carrier clutch bag of claim 1 wherein said protective cover is substantially clear.

10. The hair carrier clutch bag of claim 1 wherein the clip is a spring loaded clamp.

11. The hair carrier clutch bag of claim 1 wherein the clip lies parallel to the top of said body.

12. The hair carrier clutch bag of claim 11 wherein the clip further comprises a plurality of clips.

13. The hair carrier clutch bag of claim 1 wherein the clip lies parallel to and proximate one side of said body.

14. The hair carrier clutch bag of claim 13 wherein the clip further comprises a plurality of clips.

15. The hair carrier clutch bag of claim 1 wherein the clip is a magnetic clip.

16. The hair carrier clutch bag of claim 1 wherein the clip is an elastic clip.

17. The hair carrier clutch bag of claim 1, wherein:

said clip is disposed parallel to the top of said elongate body and is coupled to the inner surface of said elongated body proximate and offset from said top such that the hair product that is held by the clip extends toward the bottom of the elongated body; and the protective cover further includes a second cover sheet coupled to a second side of said body and configured to fold over and overlap a portion of said first cover sheet, said first and second cover sheets being configured to be removably coupled to each other in said overlapped position.

18. The hair carrier clutch bag of claim 17, further including a loop member, and wherein said top overlap section includes a hanger slot.

19. The hair carrier clutch bag of claim 18 wherein said loop member is extendable through said hanger slot.

20. A hair carrier clutch bag comprising:

(a) an elongated body having a top, a bottom, a first side, a second side, an inner surface and an outer surface, the elongated body including at least an upper fold section, a middle fold section, a lower fold section, and a top overlap section;

(b) a hair product comprising a plurality of strands of material arranged to resemble a quantity of human hair, the hair product lying lengthwise along the elongated body;

(c) a clip coupled to the inner surface of the elongated body, the clip securing the hair product in place along the elongated body;

(d) a protective cover that covers the hair product such that the hair product lies between the elongated body and the protective cover, the protective cover including a first cover sheet extending continuously along the upper, middle, and lower fold sections and having a top, a bottom, a first side, a second side, an inner surface, and an outer surface wherein one side of the first cover sheet is coupled to one side of the body and the first cover sheet is foldable about the joint formed between the one side of the first cover sheet and the one side of the body, a top edge of said first cover sheet being positioned below said clip; and (e) a closure;

(f) wherein, in a first state, the elongated body is opened flat; and (g) wherein, in a second state, the elongated body is rolled into a closed state, in which it resembles a clutch bag, such that:

(i) the inner surface of the lower fold section and corresponding portion of the protective cover are folded against the inner surface of the middle fold section, (ii) the lower and middle fold sections and corresponding portions of the protective cover are folded against the top fold section such that the outer surface of the lower fold section is disposed against the inner surface of the upper fold section, (iii) the top overlap section is folded over the upper, middle and lower fold sections such that the top overlap section is disposed against the outer surface of the middle fold section, and (iv) the closure temporarily couples the top overlap section to the outer surface of one of the fold sections.

21. A hair carrier clutch bag comprising:

(a) an elongated body having a top, a bottom, a first side, a second side, an inner surface and an outer surface, the elongated body including at least an upper fold section, a middle fold section, a lower fold section, and a top overlap section;

(b) a hair extension comprising a plurality of strands of material arranged to resemble a quantity of human hair;

(c) a clip coupled to the inner surface of the elongated body;

(d) a protective cover, including a first cover sheet having a top, a bottom, a first side, a second side, an inner surface, and an outer surface wherein one side of the first cover sheet is coupled to one side of the body and the first cover sheet is foldable about the joint formed between the one side of the first cover sheet and the one side of the body, a top edge of said first cover sheet being positioned below said clip; and (e) a closure;

(f) wherein, in a first state:

(i) the elongated body is opened flat, (ii) the hair extension is secured in place, by the clip, along the elongated body such that the hair extension lies lengthwise along the elongated body, and (ii) the protective cover covers the hair extension such that the hair extension lies between the elongated body and the protective cover; and (g) wherein, in a second state, the elongated body is rolled such that it resembles a clutch bag, in which:

(i) the inner surface of the lower fold section is folded against the inner surface of the middle fold section, (ii) the lower and middle fold sections are folded against the top fold section such that the outer surface of the lower fold section is disposed against the inner surface of the upper fold section, (iii) the top overlap section is folded over the upper, middle and lower fold sections such that the top overlap section is disposed against the outer surface of the middle fold section, (iv) the closure temporarily couples the top overlap section to the outer surface of one of the fold sections, and (b) the hair extension is enclosed within the elongated body; and (h) wherein, in a third state, the elongated body is opened flat and the hair extension is not secured by the clip but instead is attached to natural hair on the head of a live human.

* * * * *